US005238084A

United States Patent [19]

Swager

[11] Patent Number: 5,238,084

[45] Date of Patent: Aug. 24, 1993

[54] SAFETY DEVICE FOR CLIMBING LADDERS

[76] Inventor: William E. Swager, P.O. Box 750, Fremont, Ind. 46737

[21] Appl. No.: 846,041

[22] Filed: Mar. 5, 1992

[51] Int. Cl.[5] ..... E06C 7/00; A62B 1/00

[52] U.S. Cl. ..... 182/8; 182/193; 182/5

[58] Field of Search ..... 182/8, 5-7, 182/9, 189, 190, 191, 192, 193, 133-137, 146

[56] References Cited

U.S. PATENT DOCUMENTS

| | | | |
|---|---|---|---|
| 2,616,609 | 11/1952 | Herod | 182/8 |
| 3,348,632 | 10/1967 | Swager . | |
| 3,523,591 | 8/1970 | Fountain | 182/8 |
| 4,059,871 | 11/1977 | Swager | 182/8 |
| 4,085,818 | 4/1978 | Swager | 182/8 |
| 4,193,475 | 3/1980 | Sweet et al. | 182/8 |
| 4,269,284 | 5/1981 | Swager | 182/8 |
| 4,385,679 | 5/1983 | Mulcahy | 182/5 |
| 4,520,895 | 6/1985 | Armstrong | 182/9 X |
| 4,981,196 | 1/1991 | Palm | 182/191 X |

FOREIGN PATENT DOCUMENTS

| | | | |
|---|---|---|---|
| 1336836 | 7/1963 | France | 182/8 |

*Primary Examiner*—Karen J. Chotkowski

*Attorney, Agent, or Firm*—Hill, Steadman & Simpson

[57] ABSTRACT

A safety device for climbing ladders which has a body member with a rail receiving portion which is formed of cast metal such as aluminum and has a rail receiving opening which is at least partially lined with neoprene inserts so as to allow the safety device to easily slide on the rail. A pivoted clamping portion is mounted in the safety device and is biased by a spring into engagement with the rail such that the clamp locks to the rail. A safety chain is connected to the clamp device and to a belt attached to a user such that in the event of a misstep or fall, the clamping device will lock the clamp to the rail and thus arrest the climber's fall. Two or more neoprene sleeves are mounted in the safety device which engage the rail so as to allow the safety device to move smoothly over the rail when in the unclamped position.

1 Claim, 2 Drawing Sheets

SAFETY DEVICE FOR CLIMBING LADDERS

BACKGROUND OF THE INVENTION

1. Field of the Invention

This invention relates in general to climbing safety devices and in particular to a combination safety clamp and a rail upon which said clamp is mounted which may form a part of a step ladder or other device.

2. Description of Related Art

U.S. Pat. Nos. 4,085,818 and 4,059,871 disclose safety devices for climbing rails and cables.

SUMMARY OF THE INVENTION

The present invention comprises a safety clamp which is receivable upon a rail and has a clamping pawl which is spring-biased to lock the clamping device on the rail. One or more neoprene collars are mounted between the rail and the clamping device so that the clamping device will easily slide on the rail in the unlocked position to allow the clamping device to be moved relative to the rail. A locking pawl is spring biased into engagement with the rail and a safety belt is coupled to the locking pawl such that in the event of a fall or misstep, the locking device will automatically lock the clamp to the rail so as to prevent injury to the user. The use of neoprene sleeves inside the locking device facilitates the smooth and easy movement of the clamp along the rail when the locking pawl is in the unlocked position. The invention also eliminates a number of guide rollers previously used in prior art safety clamps which in some instances comprise ten or more rollers for engaging the rail and the rail web.

It is an object of the present invention to provide an improved safety clamp for engaging rails to protect a climber.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figure 3:
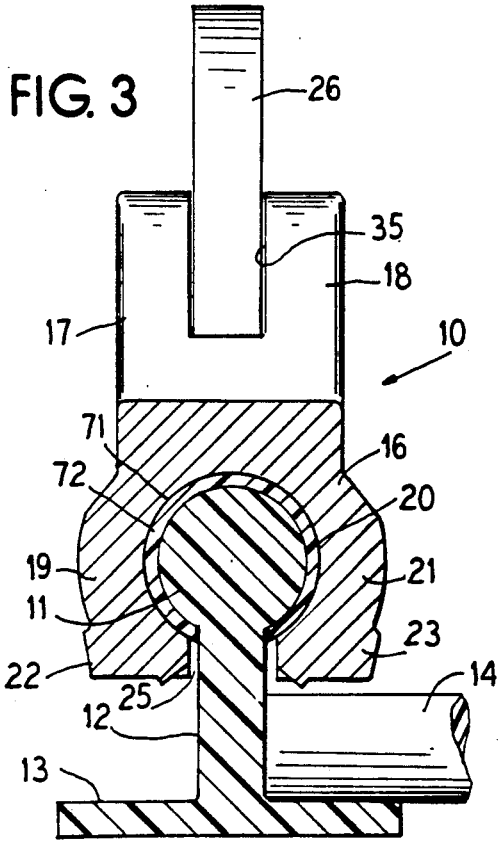
FIG. 3 is a sectional view through the safety clamp.
Figure 4:
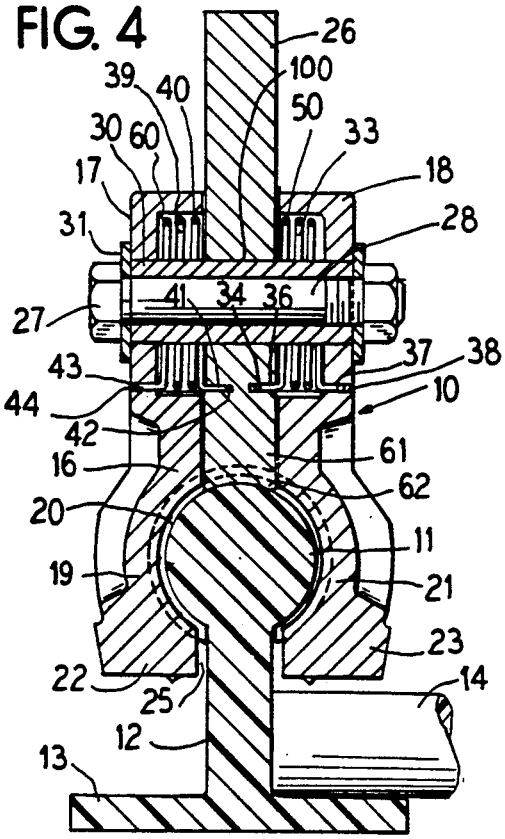
FIG. 4 is a sectional view through the safety clamp.

FIGS. 1–5 illustrate the safety clamp 10 mounted on a rail 11 which has a web 12 that is connected to a support 13 which may be part of a ladder that has steps 14 as shown in FIGS. 3 and 4.

Figure 1:
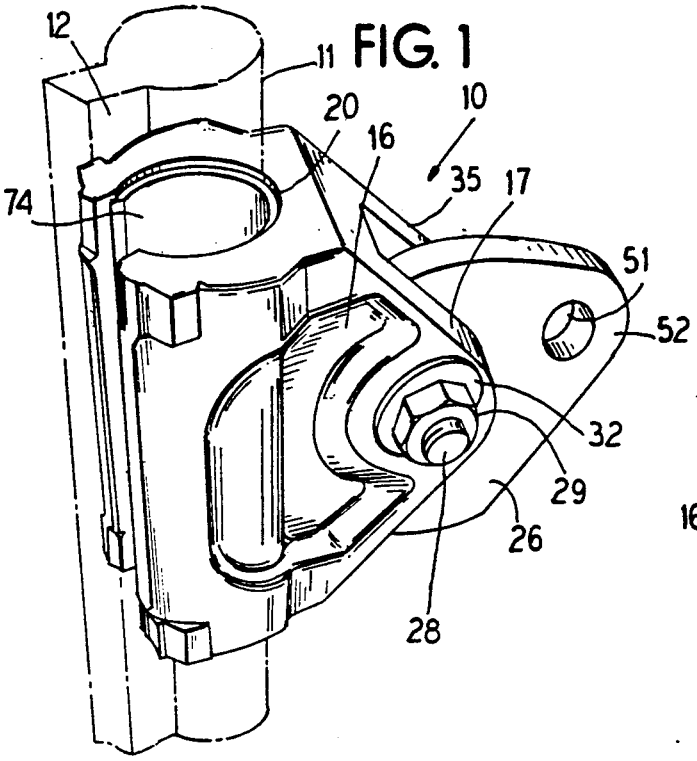
FIG. 1 is a perspective view illustrating the safety clamp of the invention.
Figure 2:
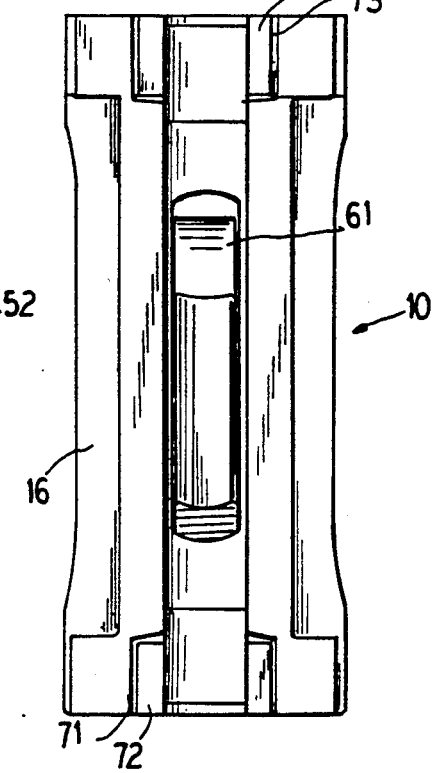
FIG. 2 is a plan view of the invention illustrating the safety clamp and locking pawl.
Figure 5:
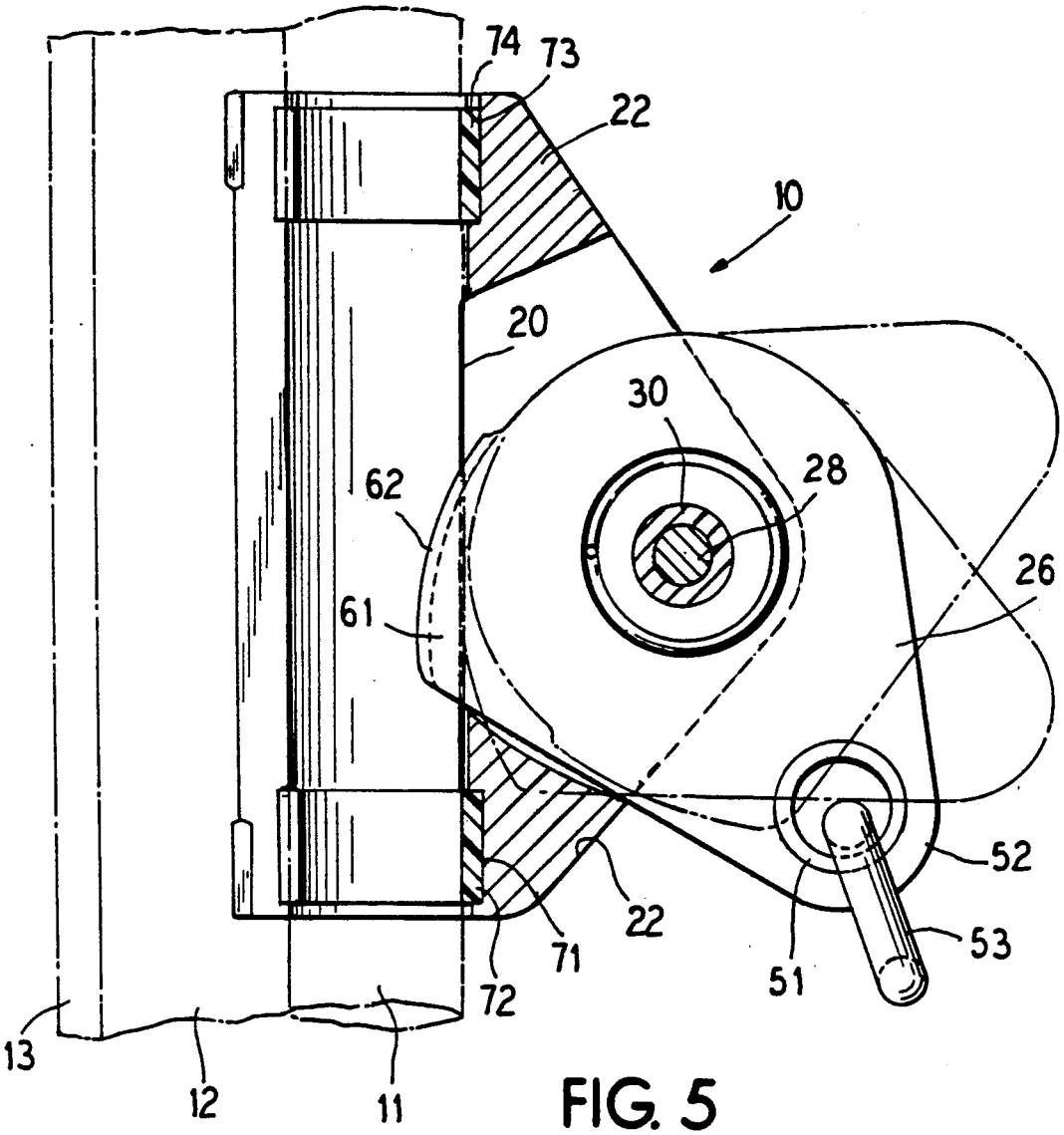
FIG. 5 is a sectional view illustrating different positions of the locking pawl.

The safety clamp 10 is formed by a main body portion 16 which is formed with a arcuate opening 20 adapted to receive the rail 11 therein through a slot 25 as shown in FIGS. 1, 3 and 4. Clamp 16 is formed with a pair of extending portions 19 and 21 which terminate with ends 22 and 23 at the slot 25. The inner surface of the arms 19 and 21 form the opening 20 in which the rail 11 is received. A pair of portions 17 and 18 extend from the clamp 16 and an opening 35 is formed therebetween in which locking pawl 26 is pivotally supported. The locking pawl 26 is formed with an opening 100 through which a bolt 28 extends. A sleeve 30 fits over the bolt 28 as best shown in FIG. 4 and 5 and the head of the bolt 27 bears against a washer 31 and a washer 32 is mounted between the other end of the bolt and a nut 29 which is threadedly received on the bolt as shown in FIGS. 1 and 4. Openings 50 and 60 are formed between the portions 18 and 17 and the locking pawl 26 and a spring 33 is mounted in the opening 50 and has one end 36 mounted in the opening 34 formed in the pawl. The other end 38 of the spring 33 is mounted in an opening 37 formed in the portion 18. A second spring 39 is mounted in the opening 60 and has an end 41 mounted in an opening 42 formed in the pawl 26. The other end 44 of the spring is mounted in an opening 43 of the portion 17. As best shown in FIG. 5, the locking pawl 26 has an extending portion 52 formed with an opening 51 into which a link 53 of a chain is mounted. The chain 53 may be connected to a belt or harness attached to the climber so as to arrest the climber's fall upon a mishap or misstep. The locking pawl 26 has an engaging portion 61 with a curved portion 62 that engages the rail 11 in the locked position.

As best shown in FIG. 5, a slot 71 is formed in the lower portion of the inner surface 20 of the clamping device and a neoprene sleeve 72 is formed in such slot. An upper slot 73 is formed in the portions 22 and 23 and a neoprene sleeve 74 is mounted in such slot. It is to be realized that the neoprene sleeves 72 and 74 extend substantially around the rail except for the slot 25 formed in the front portion of the clamping device through which the web 12 extends.

In use, the climber attaches the safety belt to the link 53 and commences to climb the ladder. As he climbs, he pulls on the link 53 so as to move the walking pawl 26 to rotate the locking pawl counterclockwise relative to FIG. 5 thus moving the locking portion 61 and the curved portion 62 out of engagement with the rail 11 so that the clamp 10 can easily slide upwardly along the rail. When the climber stops climbing, he releases the chain connected to link 53 so that cam or pawl 26 will move into the locking position due to the action of the springs 33 and 39 so that the locking pawl 26 moves to the position shown in FIG. 5 in solid line with the portion in locking engagement with the rail 11. The neoprene sleeves 72 and 74 facilitate smooth and easy movement of the clamping device as it is moved upwardly and downwardly on the rail.

It is seen that the present invention provides a novel safety clamp which eliminates a number of guide rollers of the prior art and although the invention has been described with respect to preferred embodiments, it is not to be so limited as changes and modifications can be made which are within the full intended scope of the invention as defined by the appended claims.

I claim as my invention:

1. A safety clamp for use by climbers having a body portion having a curved rail engaging portion shaped to engage and slide upon the curved portion of a rail, said curved portion supported by a web, a base mounting said web to a support such as a ladder, said body portion pivotally supporting a locking cam which has a curved surface so as to mate with the curvature of said rail, means for biasing said curved surface of said locking cam into locking engagement with said rail, said locking cam having an extending portion formed with an opening for connecting a safety chain or line which is attached to a climber for moving said locking cam, a lower slot and an upper slot formed in said curved rail engaging portion, two plastic neoprene inserts, respectively, mounted in said lower and upper slots of said curved rail engaging portion so as to facilitate sliding movement between said rail and said body portion when said locking cam is in the unlocked position.

* * * * *